US011072188B2

(12) United States Patent
Condello et al.

(10) Patent No.: US 11,072,188 B2
(45) Date of Patent: Jul. 27, 2021

(54) SYSTEM AND METHOD FOR PRODUCING HIGH QUALITY IMAGES WITH AQUEOUS INKS IN A PRINTER

(71) Applicant: Xerox Corporation, Norwalk, CT (US)

(72) Inventors: Anthony S. Condello, Webster, NY (US); Paul J. McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 61 days.

(21) Appl. No.: 16/561,413

(22) Filed: Sep. 5, 2019

(65) Prior Publication Data

US 2021/0070063 A1 Mar. 11, 2021

(51) Int. Cl.

| | |
|---|---|
| ***B41J 2/447*** | (2006.01) |
| ***B41J 2/44*** | (2006.01) |
| ***B41J 2/21*** | (2006.01) |
| ***B41J 2/125*** | (2006.01) |
| ***B41J 2/45*** | (2006.01) |
| ***B41J 2/435*** | (2006.01) |
| ***B41J 2/475*** | (2006.01) |
| *B41J 11/00* | (2006.01) |

(52) U.S. Cl.

CPC ..... *B41J 2/44* (2013.01); *B41J 2/125* (2013.01); *B41J 2/21* (2013.01); *B41J 2/435* (2013.01); *B41J 2/447* (2013.01); *B41J 2/45* (2013.01); *B41J 2/475* (2013.01); *B41J 11/002* (2013.01); *B41J 11/0015* (2013.01)

(58) Field of Classification Search

CPC ..... B41J 2/44; B41J 2/125; B41J 2/45; B41J 2/21; B41J 2/435; B41J 2/447; B41J 2/475; B41J 11/0015; B41J 11/002

See application file for complete search history.

(56) References Cited

U.S. PATENT DOCUMENTS

| | | | |
|---|---|---|---|
| 2014/0063154 A1 | 3/2014 | Gould et al. | |
| 2015/0224795 A1 | 8/2015 | Ogawa | |
| 2017/0028707 A1 | 2/2017 | Veis | |
| 2018/0111388 A1* | 4/2018 | Fujita | C09D 11/033 |
| 2018/0215139 A1 | 8/2018 | Veis | |
| 2019/0232684 A1 | 8/2019 | Ohnishi | |
| 2019/0255834 A1 | 8/2019 | Berger et al. | |

* cited by examiner

*Primary Examiner* — Henok D Legesse

(74) *Attorney, Agent, or Firm* — Maginot Moore & Beck LLP

(57) ABSTRACT

A printer includes at least a first printhead and a second printhead, each of which is operatively connected to a source of aqueous ink having a color that is different than the color of aqueous ink connected to the other printhead. A first source of infrared (IR) radiation is positioned between the first and second printheads and a second source of IR radiation follows the first and second printheads. The first source of IR radiation is tuned to heat color pigment particles in the aqueous ink connected to the first printhead only and the second source of IR radiation is tuned to heat color pigment particles in the aqueous ink connected to the second printhead only.

18 Claims, 3 Drawing Sheets

| | INK COLOR | COLOR OF LIGHT ABSORBED | APPROXIMATE WAVELENGTH OF LIGHT ABSORBED |
|---|---|---|---|
| | GREEN | RED | 700 nm |
| C | BLUE-GREEN | ORANGE-RED | 600 nm |
| | VIOLET | YELLOW | 550 nm |
| | RED-VIOLET | YELLOW-GREEN | 530 nm |
| M | RED | GREEN | 500 nm |
| | ORANGE | BLUE | 450 nm |
| Y | YELLOW | VIOLET | 400 nm |

*FIG. 3*

SYSTEM AND METHOD FOR PRODUCING HIGH QUALITY IMAGES WITH AQUEOUS INKS IN A PRINTER

TECHNICAL FIELD

This disclosure relates generally to inkjet printers, and more particularly, to inkjet printers that use aqueous inks to produce text and images on substrates.

BACKGROUND

Producing high quality images on substrates in printers with aqueous inks that are liquid at room temperature can be very challenging. Operating and maintaining the printheads so the ink drops are accurately placed on the substrates is the first issue that must be addressed to provide high image quality. Once the ink drops have been appropriately placed on the substrates, they need to remain where they have landed, although some merger with other drops may be beneficial. Uncontrollable movement of the ink drops after they have landed on the substrates, however, can produce adverse effects on the quality of the ink images. Thus, the ink drops on the substrate need to have enough stability that they remain where they land but be able to spread to a minor degree. Too much fluidity in the drops, however, is detrimental to the images because the drops then spread uncontrollably. Manageable control of aqueous ink drops on the substrates after they have been ejected would be beneficial.

SUMMARY

A new printer is configured to keep the viscosity of landed aqueous ink drops within a range that fixes them where they landed without adversely impacting the ability of the landed drops to spread to a reasonable extent. The printer includes a first printhead operatively connected to a source of aqueous ink having a first color, the first printhead being configured to eject the aqueous ink having the first color onto a substrate as the substrate passes the first printhead in a process direction, and a first source of infrared (IR) radiation following the first printhead in the process direction, the first source of IR radiation being tuned to heat color pigment particles in the aqueous ink having the first color.

A method of printer operation keeps the viscosity of landed aqueous ink drops within a range that fixes them where they landed without adversely impacting the ability of the landed drops to spread to a reasonable extent. The method includes operating a first printhead operatively connected to a source of aqueous ink having a first color to eject the aqueous ink having the first color onto a substrate as the substrate passes the first printhead in a process direction, and operating a first source of infrared (IR) radiation following the first printhead in the process direction, the first source of IR radiation being tuned to heat color pigment particles in the aqueous ink having the first color.

BRIEF DESCRIPTION OF THE DRAWINGS

The foregoing aspects and other features of a printer that keeps the viscosity of landed aqueous ink drops within a range that fixes them where they landed without adversely impacting the ability of the landed drops to spread to a reasonable extent are explained in the following description, taken in connection with the accompanying drawings.

FIG. 3 depicts a chart of the relationship between a spectrum of ink colors, the colors of light each band in the spectrum absorbs, and the wavelength range for the absorbed light.

DETAILED DESCRIPTION

Figure 1:
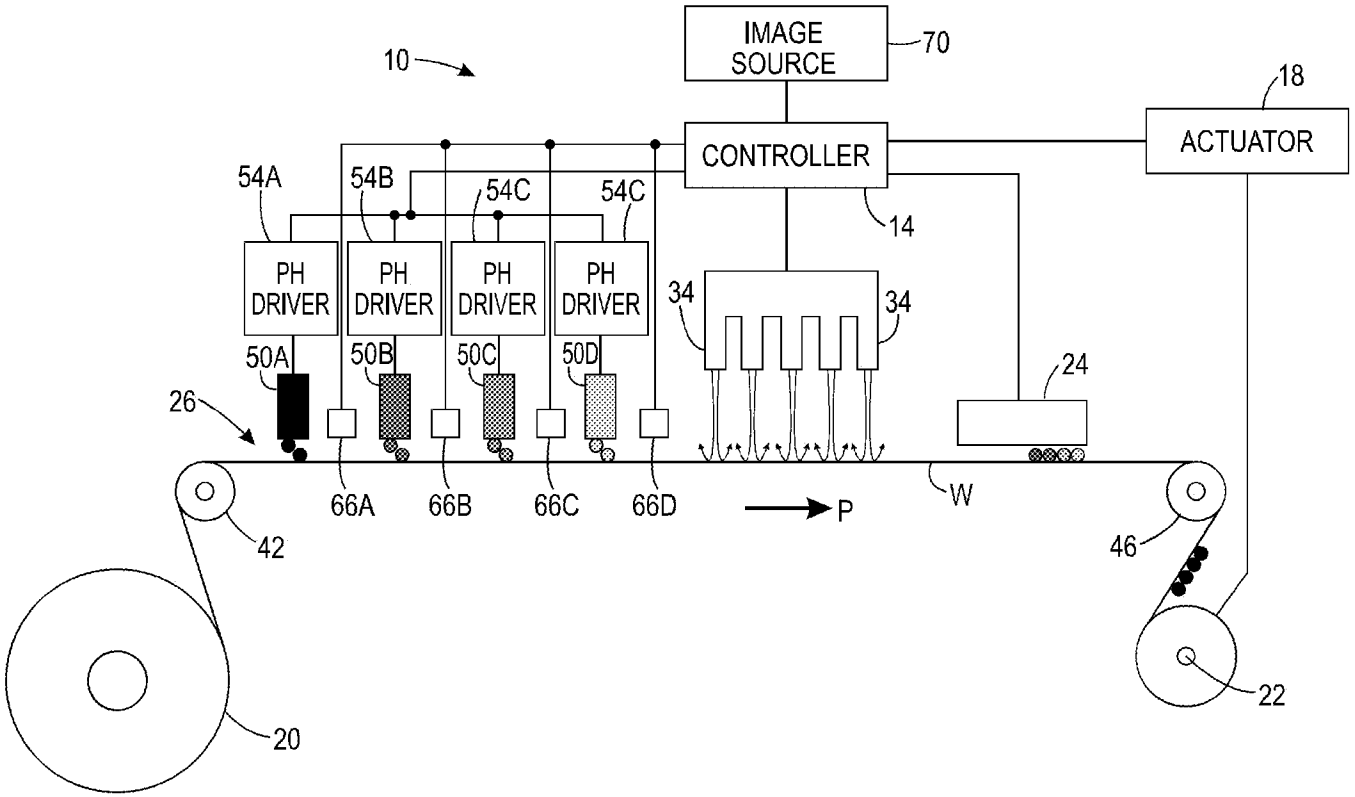
FIG. 1 is a diagram of a printer that provides different ranges of infrared radiation exposure between printhead arrays to keep the viscosity of landed aqueous ink drops within a range that fixes them where they landed without adversely impacting the ability of the landed drops to spread to a reasonable extent.

For a general understanding of the present embodiments, reference is made to the drawings. In the drawings, like reference numerals have been used throughout to designate like elements.

A printing system 10 configured to provide different ranges of infrared (IR) radiation exposure between printhead arrays during image printing to maintain the viscosity of the landed drops within a predetermined range so the drops remain where they landed yet are still able to spread and merge with other drops is shown in FIG. 1. The system 10 is a web printing system in which a controller 14 operates an actuator 18 to rotate a take-up shaft 22 after the web W has been fed through the system and a portion of the web is wrapped around the shaft 22. This rotation of the shaft 22 pulls the web from the supply roll 20 and then through a print zone 26 of the printer 10. The web W continues past a plurality of dryers 34 that finish the drying of the ink ejected onto the web in print zone 26. In one embodiment, the dryers 34 are convective heaters that direct heated air against the web. The finished printed image then passes an optical sensor 24 that generates image data of the printed image so the image data can be analyzed by the controller 14 to determine with image quality is acceptable. The optical sensor 24 can be a single line scanner comprised of LED emitters and photodetectors or a camera that generates two dimensional images. Rollers 42 and 46 are provided to maintain tension in the web W and they can be movable to adjust the tension in the web in a known manner. The supply roll 20 can be paper, coated paper, plastic, flexible packaging, foil, and the like.

Each printhead 50A, 50B, 50C, and 50D in the print zone 26 is operatively connected to a corresponding printhead driver 54A, 54B, 54C, and 54D and the controller 14 is operatively connected to these printhead drivers. Following each of the printheads 50A, 50B, 50C, and 50D in the print zone 26 is an infrared (IR) radiation source 66A, 66B, 66C, and 66D and the controller 14 is operatively connected to each one of the radiation sources. These infrared radiation sources emit different wavelengths of IR radiation. Each IR radiation source 66A, 66B, 66C, and 66D follows the printhead preceding the IR radiation source in the process direction by a predetermined distance in which the aqueous ink ejected by the immediately preceding printhead is fixed by the IR radiation source before the aqueous ink ejected by the immediately preceding printhead passes the IR radiation source. As used in this document, the term "fixed" means that the drops of aqueous ink remain where they landed and do not spread beyond the landing area of an aqueous ink drop by more than a predetermined toleration parameter. In one embodiment, this toleration parameter is about twice a diameter of a nominal aqueous ink drop. As used in this document, the term "spread" means that the ink expands symmetrically beyond the landing site of an aqueous ink drop by no more than the predetermined toleration parameter.

The controller 14 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

The controller 14 is operatively connected to an image source 70. Image source 70 can be a scanner, database, or other image generation or data source. An image that the controller 14 obtains from the image source 70 is used to operate the printer 10 to form an ink image on the web W corresponding to the obtained image. The controller 14 processes the image obtained from the image source in a known manner for control of the printhead drivers 54A to 54D. Specifically, a composite image is obtained from the image source 70. As used in this document, the term "composite image" refers to pixel data for each color and feature present in an image. The controller processes the composite image to produce color separation files that correspond to the colors of ink ejected by the printheads in the print zone. Additional processing can also occur in a known manner such as halftoning and the like. Each color separation file derived from the composite image is supplied to the printhead driver corresponding to the printhead in the print zone 26 that ejects the color ink corresponding to the color separation file. For example, the black color separation file derived from the composite image is delivered to the printhead driver 54A, which operates the printhead 50A that ejects black ink. As used in this document, the term "print zone" means an area directly opposite a plurality of printheads that forms an ink image on a substrate using color separation files. The term "process direction" means the direction in which media moves through the print zone as the inkjets eject ink onto the sheets and the term "cross-process direction" means an axis that is perpendicular to the process direction in the plane of the media in the print zone.

In previously known printers, partially drying aqueous inks of different colors between printheads to fix the locations of the ink drops of one color before the next color is printed could not be effectively achieved because aqueous ink drops require evaporation for fixing their locations. Efforts to fix ink drops by drying them with convective dryers between printheads were not effective because convective hot air dryers are too large to fit within a print zone without disrupting the printing in the print zone and the high velocity of the air flow from such dryers in close proximity to the ejected ink drops negatively effects ink drop placement. To overcome these limitations of using previously known dryers in a print zone, IR radiation sources of different wavelengths are positioned between printheads or printhead arrays of different colors. This IR radiation drying is effective because the color pigments in the different colors of aqueous inks couple differently to the IR radiation wavelengths. Each IR radiation source in the print zone 26 is selected so the color pigments in the color of ink ejected by the printhead or printhead array immediately preceding the IR radiation source absorbs enough IR radiation energy to fix the newly ejected drops before the drops move opposite the next printhead in the print zone. The wavelength and intensity of the IR radiation source fixes the ink drops ejected by the immediately preceding printhead or printhead array without overheating the ink drops so they are unable to spread beyond the toleration parameter as the ink proceeds through the print zone.

These goals are achieved by using high energy LED IR radiation sources that are tuned for each ink color. As used in this document, the term "tuned" means a LED IR radiation source that emits a wavelength of IR radiation that heats the color pigment particles in the ink ejected by the printhead immediately preceding the IR radiation source. Thus, each color of ink ejected by a printer has its own LED IR radiation source that can be controlled to obtain optimal drying for each color. The ink colors for which LED IR radiation sources can be obtained include the more common cyan, magenta, yellow, and black (CMYK) but they may also include spot or specialty colors. The LED IR wavelength bands of the selected LED IR radiation sources are narrow so they deliver most of their energy to the color pigments on the substrate that were ejected by the printhead immediately preceding a LED IR radiation source. Any pigment particles of other colors on the substrate receive little, if any, of the IR radiation. Proper selection of the narrow IR radiation bandwidth for a LED IR radiation source helps ensure proper drying of each ink and results in images with high quality fine features, edges, and solid areas. It also helps eliminate mottle and edge blurriness. Additionally, this approach largely eliminates any need to draw waste heat from the backside of the substrate while the substrate passes through the print zone because the selection IR radiation emissions do not significantly heat the substrate. Previously, the backside of a substrate was cooled in the print zone if heated air was directed toward the substrate in the print zone to prevent damage to the sometimes thin and temperature sensitive substrates. A chart of the relationship between a spectrum of ink colors, the colors of light each band in the spectrum absorbs, and the wavelength range for the absorbed light is shown in FIG. 3.

In one embodiment that uses CMYK inks, a first LED IR radiation source emits IR radiation having a wavelength in a range of about 650 nm to about 575 nm, which causes cyan pigment particles to absorb orange-red light; a second LED IR radiation source emits IR radiation having a wavelength in a range of about 515 nm to about 475 nm, which causes magenta pigment particles to absorb yellow-green light; a third LED IR radiation source emits IR radiation having a wavelength in a range of about 425 nm to about 375 nm, which causes yellow pigment particles to absorb violet light; and a fourth LED IR radiation source emits IR radiation having a wavelength in a range of about 650 nm to about 375 nm, which causes black pigment particles to absorb white light. The fourth LED IR radiation source can be implemented with an array of LEDs having at least one LED IR radiation source emitting light in the range of the first LED IR radiation source, at least one LED IR radiation source emitting light in the range of the second LED IR radiation source, and at least one LED IR radiation source emitting light in the range of the first LED IR radiation source. Alternatively, the fourth LED IR radiation source can be implemented with a one or more LEDs that emit white light. Because the fourth LED IR radiation source emits light having wavelengths across the spectrum, the black ink ejecting printhead or printhead array is either first in the process direction so the IR radiation from this source does not heat any pigment particles corresponding to other colors or last in the process direction since the other colors have already been exposed to the appropriate wavelength of light.

Figure 2:
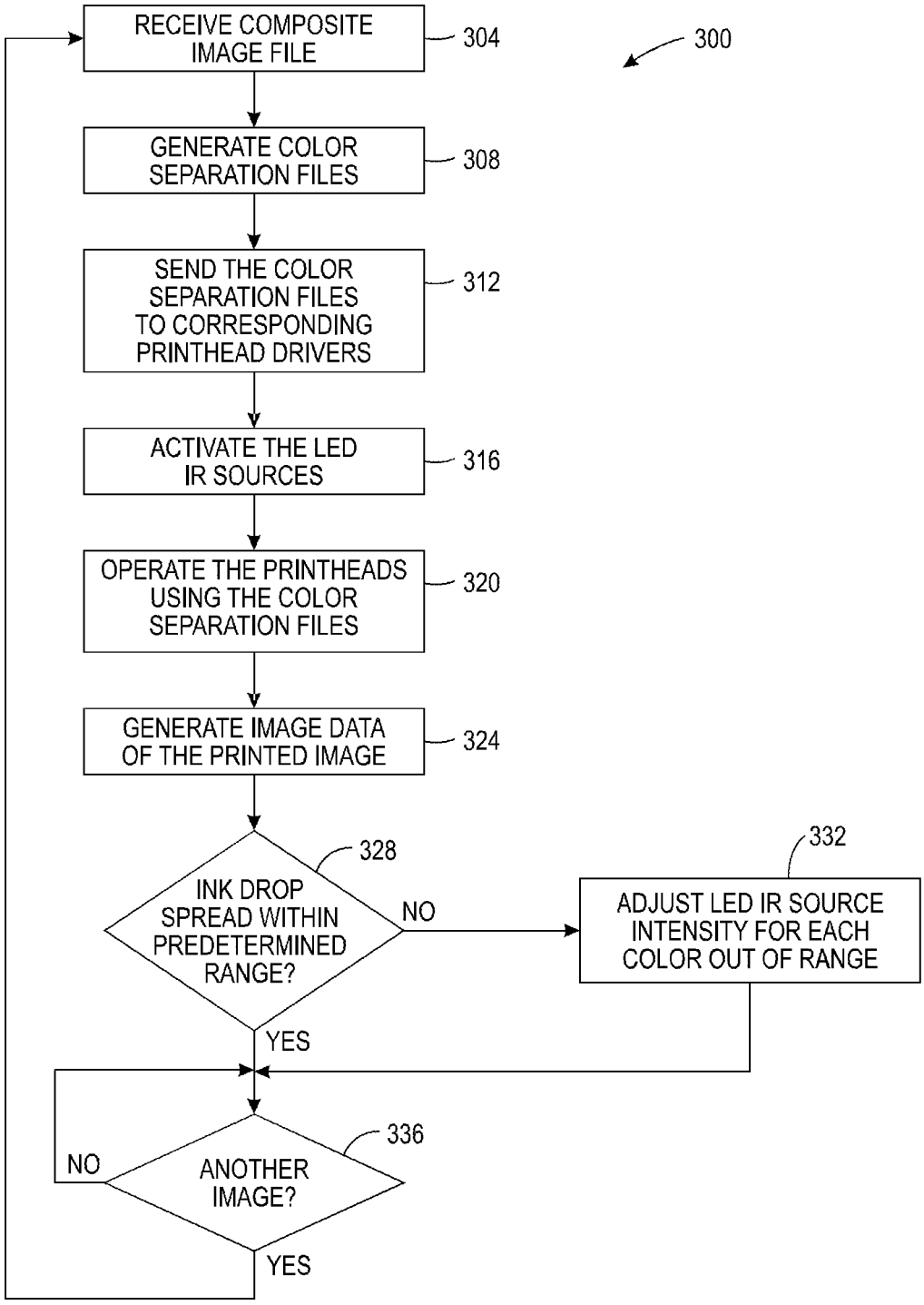
FIG. 2 depicts a process for operating the printer of FIG. 1.

A process for operating the printer shown in FIG. 1 is shown in FIG. 2. In the description of the process, statements that the process is performing some task or function refers to a controller or general purpose processor executing programmed instructions stored in non-transitory computer readable storage media operatively connected to the controller or processor to manipulate data or to operate one or more components in the printer to perform the task or function. The controller 14 noted above can be such a controller or processor. Alternatively, the controller can be implemented with more than one processor and associated circuitry and components, each of which is configured to form one or more tasks or functions described herein. Additionally, the steps of the method may be performed in any feasible chronological order, regardless of the order shown in the figures or the order in which the processing is described.

FIG. 2 is a flow diagram of a process 300 that operates the printing system 10 to provide varying ranges of IR radiation exposure at different times during image printing to improve the sharpness of fine image features and to establish uniform solid areas with accurate formation of colors in those areas. The process 300 begins by receiving a composite image file (block 304). The controller then generates color separation files from the composite image file (block 308). The color separation files are sent to the printhead drivers that operate the printheads that eject the corresponding ink colors (block 312). The LED IR radiation sources for the print zone are activated (block 316) and the printhead drivers then operate the printheads in the print zone using the color separation files to form the ink image on the web (block 320). The activated LED IR radiation sources fix the ink drops ejected by an immediately preceding printhead before the ink drops proceed to the next printhead. As the printed images pass the optical sensor, image data of the printed images are generated and analyzed by the controller (block 324). If the controller determines that one or more colors are not spreading enough or too much (block 328), the intensity of the light emitted from the LED IR source for that color is adjusted (block 332). To address ink drops of a color spreading too much, the intensity of the emitted light for that color is increased by increasing the power supplied to the LED IR source. To address ink drops of a color spreading too little, the intensity of the emitted light for that color is decreased by decreasing the power supplied to the LED IR source. If adjustments are necessary and no additional images are available for printing (block 336), the process waits until another image is ready for printing. At that time, the process obtains the composite image (block 304) and the process repeats.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a first printhead operatively connected to a source of aqueous ink having a first color, the first printhead being configured to eject the aqueous ink having the first color onto a substrate as the substrate passes the first printhead in a process direction;

a first source of infrared (IR) radiation following the first printhead in the process direction, the first source of IR radiation being tuned to heat color pigment particles in the aqueous ink having the first color;

a second printhead operatively connected to a source of aqueous ink having a second color that is different than the first color, the second printhead following the first source of IR radiation in the process direction and being configured to eject the aqueous ink having the second color onto the substrate after the substrate has passed the first printhead and the first source of IR radiation; and a second source of IR radiation following the second printhead in the process direction, the second source of IR radiation being tuned to heat color pigment particles in the aqueous ink having the second color and not heat color pigment particles in the aqueous ink having the first color.

2. The printer of claim 1 further comprising:

a third printhead operatively connected to a source of aqueous ink having a third color that is different than the first color and the second color, the third printhead following the second source of IR radiation in the process direction and being configured to eject the aqueous ink having the third color onto the substrate after the substrate has passed the second printhead and the second source of IR radiation; and a third source of IR radiation following the third printhead in the process direction, the third source of IR radiation being tuned to heat color pigment particles in the aqueous ink having the third color and not heat color pigment particles in the aqueous ink having the first color and not heat color pigment particles in the aqueous ink having the second color.

3. The printer of claim 2 further comprising:

a fourth printhead operatively connected to a source of aqueous ink having a fourth color that is different than the first color, the second color, and the third color, the fourth printhead following the third source of IR radiation in the process direction and being configured to eject the aqueous ink having the fourth color onto the substrate after the substrate has passed the third printhead and the third source of IR radiation; and a fourth source of IR radiation following the fourth printhead in the process direction, the fourth source of IR radiation being tuned to heat color pigment particles in the aqueous ink having the fourth color and not heat color pigment particles in the aqueous ink having the first color and not heat color pigment particles in the aqueous ink having the second color and not heat color pigment particles in the aqueous ink having the third color.

4. The printer of claim 3 wherein the first color is black, the second color is cyan, the third color is magenta, and the fourth color is yellow; and the first source of IR radiation emits infrared radiation in a range of about 375 nm to about 650 nm;

the second source of IR radiation emits infrared radiation in a range of about 575 nm to about 650 nm;

the third source of IR radiation emits infrared radiation in a range of about 475 nm to about 515 nm; and the fourth source of IR radiation emits infrared radiation in a range of about 375 nm to about 425 nm.

5. The printer of claim 4 wherein each source of IR radiation is a light emitting diode (LED) that emits IR radiation.

6. The printer of claim 5 further comprising:

an optical sensor positioned in the process direction after the substrate has passed the fourth source of IR radiation, the optical sensor being configured to generate image data of printed images on the substrate; and a controller operatively connected to the optical sensor, the controller being configured to detect whether ink drop spread for the ink drops ejected by the first printhead, the second printhead, the third printhead, or fourth printhead is whether a predetermined range.

7. The printer of claim 6 wherein the controller is further configured to:

increase an intensity of the infrared radiation emitted by one of the first LED IR radiation source, the second LED IR radiation source, the third LED IR radiation source, and the fourth LED IR radiation source when the ink drop spread for the ink drops emitted by one of the first LED IR radiation source, the second LED IR radiation source, the third LED IR radiation source, and the fourth LED IR radiation source exceeds the predetermined range; and decrease an intensity of the infrared radiation emitted by one of the first LED IR radiation source, the second LED IR radiation source, the third LED IR radiation source, and the fourth LED IR radiation source when the ink drop spread for the ink drops emitted by one of the first LED IR radiation source, the second LED IR radiation source, the third LED IR radiation source, and the fourth LED IR radiation source is less than the predetermined range.

8. The printer of claim 4 wherein the fourth source of IR radiation emits white light.

9. The printer of claim 4, the fourth source of IR radiation further comprising:

a fifth source of IR radiation that emits infrared radiation in a range of about 575 nm to about 650 nm;

a sixth source of IR radiation that emits infrared radiation in a range of about 475 nm to about 515 nm; and a seventh source of IR radiation that emits infrared radiation in a range of about 375 nm to about 425 nm.

10. A method for operating a printer comprising:

operating a first printhead operatively connected to a source of aqueous ink having a first color to eject the aqueous ink having the first color onto a substrate as the substrate passes the first printhead in a process direction;

operating a first source of infrared (IR) radiation following the first printhead in the process direction, the first source of IR radiation being tuned to heat color pigment particles in the aqueous ink having the first color;

operating a second printhead operatively connected to a source of aqueous ink having a second color that is different than the first color to eject the aqueous ink having the second color onto the substrate after the substrate has passed the first printhead and the first source of IR radiation; and operating a second source of IR radiation following the second printhead in the process direction, the second source of IR radiation being tuned to heat color pigment particles in the aqueous ink having the second color and not heat color pigment particles in the aqueous ink having the first color.

11. The method of claim 10 further comprising:

operating a third printhead operatively connected to a source of aqueous ink having a third color that is different than the first color and the second color to eject the aqueous ink having the third color onto the substrate after the substrate has passed the second printhead and the second source of IR radiation; and operating a third source of IR radiation following the third printhead in the process direction, the third source of IR radiation being tuned to heat color pigment particles in the aqueous ink having the third color and not heat color pigment particles in the aqueous ink having the first color and not heat color pigment particles in the aqueous ink having the second color.

12. The method of claim 11 further comprising:

operating a fourth printhead operatively connected to a source of aqueous ink having a fourth color that is different than the first color, the second color, and the third color to eject the aqueous ink having the fourth color onto the substrate after the substrate has passed the third printhead and the third source of IR radiation; and operating a fourth source of IR radiation following the fourth printhead in the process direction, the fourth source of IR radiation being tuned to heat color pigment particles in the aqueous ink having the fourth color and not heat color pigment particles in the aqueous ink having the first color and not heat color pigment particles in the aqueous ink having the second color and not heat color pigment particles in the aqueous ink having the third color.

13. The method of claim 12 wherein the first color is black, the second color is cyan, the third color is magenta, and the fourth color is yellow; and the first source of IR radiation is operated to emit infrared radiation in a range of about 375 nm to about 650 nm;

the second source of IR radiation is operated to emit infrared radiation in a range of about 575 nm to about 650 nm;

the third source of IR radiation is operated to emit infrared radiation in a range of about 475 nm to about 515 nm; and the fourth source of IR radiation is operated to emit infrared radiation in a range of about 375 nm to about 425 nm.

14. The method of claim 13 wherein the operation of each source of IR radiation is an operation of a light emitting diode (LED) that emits IR radiation.

15. The method of claim 14 further comprising:

operating an optical sensor positioned in the process direction after the substrate has passed the fourth source of IR radiation to generate image data of printed images on the substrate; and detecting with a controller operatively connected to the optical sensor whether ink drop spread for the ink drops ejected by the first printhead, the second printhead, the third printhead, or fourth printhead is within a predetermined range.

16. The method of claim 15 further comprising:

increasing an intensity of the infrared radiation emitted by one of the first LED IR radiation source, the second LED IR radiation source, the third LED IR radiation source, and the fourth LED IR radiation source when the ink drop spread for the ink drops emitted by one of the first LED IR radiation source, the second LED IR radiation source, the third LED IR radiation source, and the fourth LED IR radiation source exceeds the predetermined range; and decreasing an intensity of the infrared radiation emitted by one of the first LED IR radiation source, the second LED IR radiation source, the third LED IR radiation source, and the fourth LED IR radiation source when the ink drop spread for the ink drops emitted by one of the first LED IR radiation source, the second LED IR radiation source, the third LED IR radiation source, and the fourth LED IR radiation source is less than the predetermined range.

17. The method of claim 13 wherein the operation of the fourth source of IR radiation emits white light.

18. The method of claim 13, the operation of the fourth source of IR radiation further comprises:

operating a fifth source of IR radiation that emits infrared radiation in a range of about 575 nm to about 650 nm;

operating a sixth source of IR radiation that emits infrared radiation in a range of about 475 nm to about 515 nm; and operating a seventh source of IR radiation that emits infrared radiation in a range of about 375 nm to about 425 nm.

* * * * *